United States Patent [19]

Bock

[11] 4,393,816

[45] Jul. 19, 1983

[54] THERMODYNAMIC METHOD FOR STEAM-WATER SEPARATION

[76] Inventor: Paul A. Bock, 2246 N. Edinboro Ave., Claremont, Calif. 91711

[21] Appl. No.: 347,470

[22] Filed: Feb. 10, 1982

[51] Int. Cl.[3] ..... F22D 1/00

[52] U.S. Cl. ..... 122/412; 122/414; 122/1 C; 122/488; 122/489

[58] Field of Search ..... 122/488, 489, 1 B, 1 C, 122/406 S, 412, 414

[56] References Cited

U.S. PATENT DOCUMENTS

| | | | |
|---|---|---|---|
| 2,908,255 | 10/1959 | Michel | 122/412 |
| 4,249,486 | 2/1981 | Potschnik | 122/412 |
| 4,258,668 | 3/1981 | Bekedam | 122/412 |
| 4,261,298 | 4/1981 | McDonald et al. | 122/488 |
| 4,318,366 | 3/1982 | Tompkins | 122/412 |

*Primary Examiner*—Henry C. Yuen
*Attorney, Agent, or Firm*—Philip D. Junkins

[57] ABSTRACT

A thermodynamic method is described and claimed for improving the quality of wet steam produced by conventional and once through type boilers. Moisture entrained with such steam is first separated in a steam-water separation vessel. The separated moisture is thereafter vaporized by pressure reduction and flashed to form lower pressure steam and condensate containing dissolved solids. The condensate is utilized to preheat fresh boiler feedwater. The lower pressure steam is condensed and supplements the boiler feedwater to form a hotter combined net feedwater stream containing reduced quantities of dissolved solids. Practice of the method, in association with commercially available boilers producing saturated to moderately superheated steam at temperatures of up to about 970° F. and steam pressures of up to about 2,900 psig, has resulted in increases in the quality of the steam produced from about 70% to about 99% (substantially dry steam). Further, the method includes heating of the fresh boiler feedwater from ambient temperature to about 200° F. without the utilization of additional fuel by the boiler system. Also, less fresh boiler feedwater is required to produce the same net process heating value of the steam product.

7 Claims, 3 Drawing Figures

THERMODYNAMIC METHOD FOR STEAM-WATER SEPARATION

BACKGROUND OF THE INVENTION

The present invention is related to a novel method for improving the quality of the steam produced by boilers through the removal of water therefrom while economically preheating the feedwater supplied to such boilers. Steam quality is the percentage of feedwater vaporized to steam. In once through type boilers 70 to 90% of the feedwater is converted to steam. The unvaporized water contains and carries dissolved solids and scale forming minerals. When the feedwater contains very high quantities of dissolved solids, silica and other solid impurities, the boilers must operate at lower levels of steam quality. The method of the present invention increases steam quality by first separating the unvaporized water containing the solid impurities and thereafter recovering part of such water and its heat content. The method is particularly applicable to commercial boilers producing saturated to moderately superheated steam at pressures of as great as 2900 psig. Typical of the commercial boilers to which the present thermodynamic method may be applied are oil field steamers, steam generators, hot water floods (fired by crude oil, refined oil or gas), or fluidized or circulating bed combustors burning coal, peat, wood wastes, municipal and household wastes, and waste sludges.

SUMMARY OF THE INVENTION

Once through type boilers producing 20,000 to 200,000 lbs/hr of saturated to moderately superheated steam (600°–970° F.) at pressures of 500–2,900 psig typically yield a steam quality of about 70–90%, i.e., a steam containing an entrained moisture content of as much as 30% by weight.

It is an object of the present invention to provide an improved thermodynamic method for increasing the quality of steam produced by boilers normally yielding saturated to moderately superheated steam (600°–970° F.).

A further object of the invention is to provide an improved thermodynamic method for increasing the quality of steam produced by boilers normally yielding saturated to moderately superheated steam containing up to about 30% by weight of entrained moisture, removing dissolved solids from such steam and preheating the feedwater supplied to the boiler producing such steam.

Another object of the present invention is to provide an improved thermodynamic method for increasing the quality of steam produced by boilers normally yielding saturated to moderately superheated steam containing entrained moisture which is capable of practice in a modulized structure, or packaged combination, of apparatus readily combinable with such boilers.

In accordance with the invention saturated to moderately superheated steam (wet steam: 30% moisture) from a boiler is received by the thermodynamic system and introduced to a high pressure steam-water separation vessel wherein moisture in the steam is separated by demister pads or other conventional means and high quality dry steam is produced for process or heating use. The separated moisture, as a high pressure (high temperature) water stream, is removed from the high pressure separator vessel and passed through a pressure reducing control valve and thereafter as steam is flashed into a low pressure flash vessel. In the low pressure flash vessel such steam is again dried by the separation of moisture through the utilization of demister pads or other conventional means. The low pressure dry steam is passed to a condensing heat exchanger wherein, during its cooling to condensate form, it heats feedwater for the associated boiler. The separated moisture in the low pressure flash vessel, as a low pressure water stream which is loaded with dissolved solids from the original wet steam, is passed to a feedwater preheater. After giving up heat to the feedwater in this heat exchanger the relatively cool low pressure water stream is discharged (with dissolved solids) by blowdown to a sewer.

Condensate from the condensing heat exchanger is free of dissolved solids and is passed through a steam trap to a feedwater holding and mixing tank. In such tank the hot, solids-free condensate is mixed with fresh boiler feedwater which has been preheated by its passage through the feedwater preheater in indirect heat exchange with the low pressure water stream passing from the low pressure flash vessel to sewer discharge. Relatively hot boiler feedwater is removed from the mixing tank and is pumped by an appropriate feedwater pump through the condensing heat exchanger for further heating prior to passage to the associated boiler. Final preheating of the feedwater stream in the condensing heat exchanger is accomplished by indirect heat exchange of the feedwater with the dry steam leaving the low pressure flash vessel and passing to the feedwater mixing tank.

DESCRIPTION OF THE PREFERRED EMBODIMENT

Figure 1:
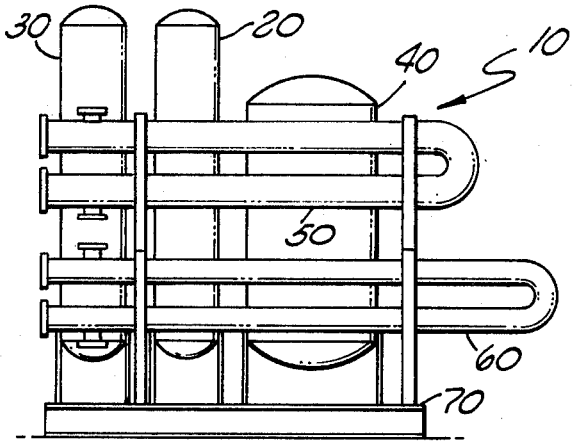
FIG. 1 is a side view of one possible modular grouping of apparatus suggested for performing the steam and feedwater processing method of the present invention. Interconnecting piping and control valve placement is not illustrated.
Figure 2:
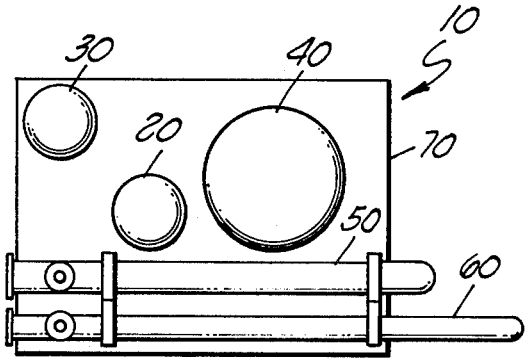
FIG. 2 is a plan view of the modular apparatus grouping of FIG. 1.

The present invention is herein illustrated and described as embodied in modular apparatus and a system which can be readily installed at an existing boiler installation of the type previously described. The modular thermodynamic apparatus package 10 of FIG. 1 and FIG. 2 includes five basic items including: high pressure separator vessel 20; low pressure flash vessel 30; holding and mixing tank 40; condensing heat exchanger 50; and feedwater preheater 60. As shown in FIGS. 1 and 2 the thermodynamic apparatus package 10 is mounted on a transportable skid base 70.

Figure 3:
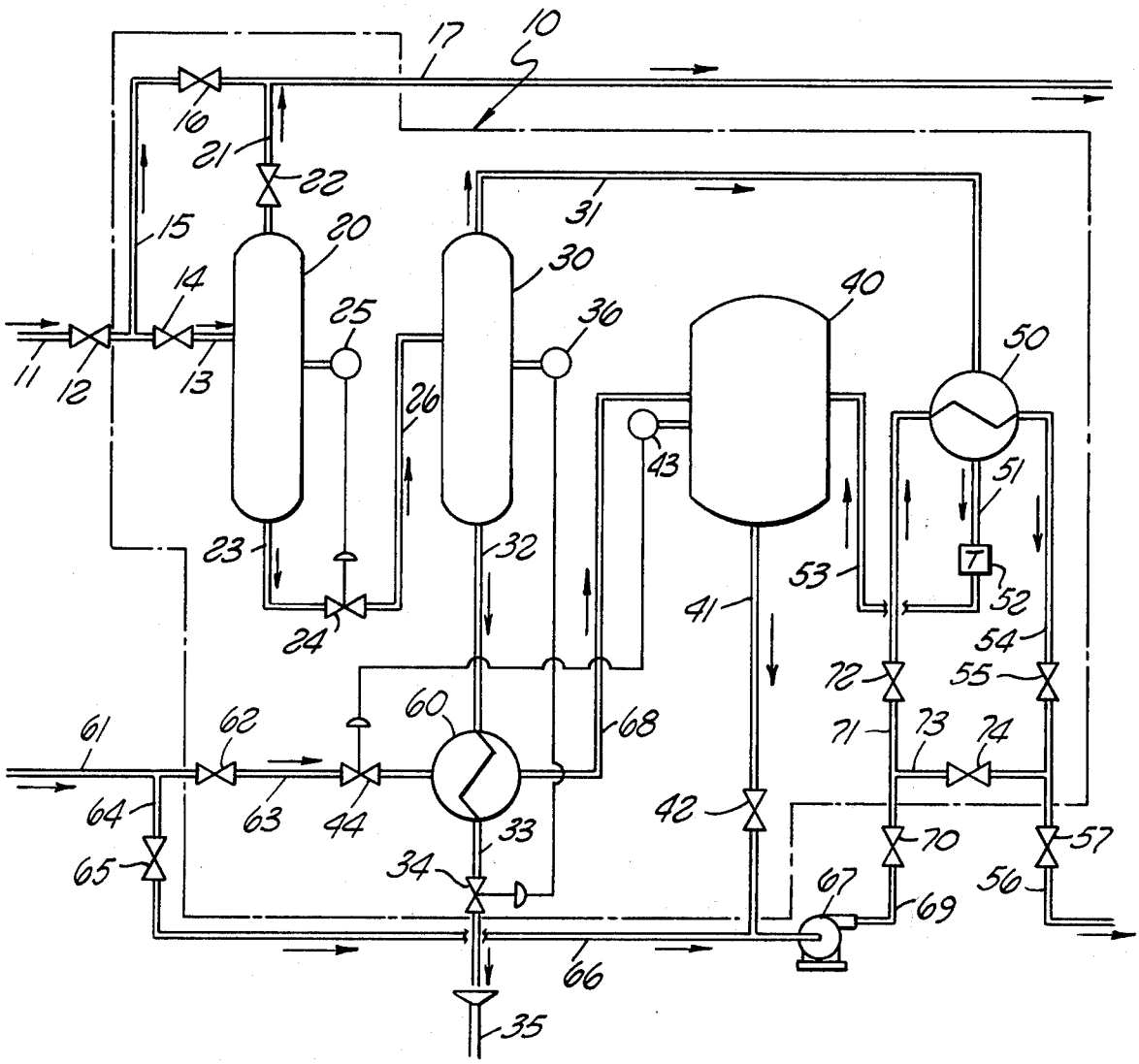
FIG. 3 is a schematic process flow diagram of the steam quality improvement method of the present invention.

Referring now to FIG. 3, saturated to moderately superheated process steam (wet steam) from a boiler (not shown) is received by the thermodynamic system 10 through line 11 and stop valve 12 and introduced via line 13 to the high pressure steam-water separation vessel 20. In the event that it is necessary to isolate the thermodynamic system from the process steam line 11, a stop valve 14 in line 13 and valve 22 in line 21 may be shut down thereby diverting the wet process steam through line 15, valve 16 to product steam line 17. Entrained moisture in the steam entering the vessel 20 is separated by demister pads or other conventional means and high quality, high pressure dry product steam is produced for process or heating use. The dry product steam leaves separator vessel 20 through overhead line 21, which includes stop valve 22, and leaves the thermodynamic separator system 10 through product steam line 17. When the thermodynamic system 10 is operational in the boiler's product steam line 11, valves 12,14 and 22 are fully open and valve 16 is completely closed.

The moisture separated from the steam entering the separator vessel 20 accumulates in the lower portion of such vessel as high pressure, high temperature water and is removed therefrom through bottom line 23 and pressure reducing control valve 24. The level of the high temperature water in vessel 20 is monitored by a water level controller 25 which regulates the control valve 24. Upon passage through the pressure reducing valve 24 the hot water from vessel 20 vaporizes to form low pressure steam which passes through line 26 and is flashed into low pressure flash vessel 30. In the flash vessel 30 such steam is again dried by the separation of moisture through the utilization of demister pads or other conventional means.

The relatively hot, low pressure dry steam in flash vessel 30 is passed through overhead line 31 to a condensing heat exchanger 50 wherein, during its cooling to condensate form, it indirectly heats feedwater for the associated boiler (not shown). The separated moisture in the low pressure flash vessel 30 accumulates in the lower portion of such vessel as low pressure, low temperature water and is loaded with dissolved solids from the original high pressure wet steam entering the thermodynamic system 10. Such water is removed from flash vessel 30 through bottom line 32 and is passed to a feedwater preheater 60. After giving up heat (by indirect exchange) to the feedwater in the heater 60 the relatively cool low pressure water stream leaves such heater (with dissolved solids) through line 33 and is discharged by blow down through pressure reducing control valve 34 to a sewer line 35. The level of the low pressure, low temperature water in flash vessel 30 is monitored by a water level controller 36 which regulates the control valve 34.

Condensate from the condensing heat exchanger 50 is substantially free of dissolved solids and leaves exchanger 50 through line 51 and is passed through a steam trap 52 and line 53 to a feedwater holding and mixing tank 40. In such tank the hot, solids-free condensate is mixed with fresh boiler feedwater which has been preheated by its passage through the feedwater preheater 60 in indirect heat exchange with the low pressure water stream in line 32 passing from the low pressure flash vessel 30 to sewer discharge.

Cold boiler feedwater enters the thermodynamic system 10 through line 61, stop valve 62 and line 63 and passes through feedwater preheater 60 where it is preheated by indirect heat exchange with relatively hot low pressure water leaving flash vessel 30 through bottom line 32. In the event that it is necessary to isolate the thermodynamic system from the associated steam producing boiler, the stop valve 62 in line 61 may be shut down thereby diverting the cold feedwater through line 64, valve 65 and line 65 directly to high pressure feedwater pump 67 associated with the steam producing boiler. With the thermodynamic system 10 in operation in the boiler's feedwater system, valve 62 is fully open and valve 65 is completely closed. After passing through the feedwater preheater 60 the preheated feedwater is passed through line 68 to the feedwater holding and mixing tank 40 for mixing with hot, solids-free condensate entering such tank through line 53. Preheated feedwater and hot condensate mix and accumulate in tank 40 and leave such tank through line 41 as a combined hot feedwater stream (lower in dissolved solids then the fresh feedwater of line 61). Feedwater line 41 interconnects with feedwater line 66 leading to feedwater pump 67. A stop valve 42 is located in line 41 and remains fully open so long as the thermodynamic system of this invention remains in operation with respect to the process steam line 11 and feedwater line 61 of the associated boiler. The level of mixed feedwater in tank 40 is monitored by a water level controller 43 which regulates the control valve 44 located in feedwater line 63 leading to feedwater preheater 60.

Preheated mixed feedwater in line 41 is received by feedwater pump 67 and is pumped at high pressure through line 69, stop valve 70, line 71 (including stop valve 72) to condensing heat exchanger 50 wherein the feedwater is further heated (via indirect heat exchange) by low pressure steam received from flash vessel 30 via steam line 31. After final heating in exchanger 50 the high pressure, hot feedwater passes through line 54, stop valve 55 and line 56 (including stop valve 57) to the associated boiler. If the thermodynamic system of this invention is not operational with respect to its associated boiler, cold boiler feedwater from line 61 passes through line 64, valve 65 to pump 67 wherefrom it is pumped at high pressure through line 69, valve 70, line 73 (including valve 74) and line 56 (including valve 57) to the boiler's feedwater drum (not shown). In this situation valves 65, 70, 74 and 57 are fully open and valves 62, 42, 72 and 55 are completely closed.

Through incorporation of a modular thermodynamic system of this invention (as described above) in association with a conventional boiler system producing saturated or moderately superheated steam, substantial operational advantages may be gained and heat economies effected. These advantages and economies include: the production of a higher quality (drier) steam with lower quantities of net feedwater required; lower quantities of dissolved solids in the net feedwater stream; and feedwater preheating outside of the associated boiler system at no increased fuel cost. The following example will further illustrate the nature of the unique thermodynamic method of the invention, it being understood that the invention is not limited to the operating conditions or quantities therein.

EXAMPLE

A modular thermodynamic system, including apparatus as described above, arranged substantially as shown in FIGS. 1 and 2, and interconnected in accordance with the schematic process flow diagram of FIG. 3, was designed to interface with a commercially available 50,000 lb/hr fluidized bed combustion (FBC) boiler producing 2,500 psig steam (670° F.) having a quality of 80% (20% entrained moisture). The heat and material balance data and the systems performance data, derived during operational interaction with the boiler, are set forth in tabular form below:

Heat and Material Balance & Performance Data

| Data Point Description | Line 61 Cold BFW Inlet | Line 41 FW Pump Suction | Line 69 FW Pump Discharge | Line 56 Hot BFW Outlet | Line 11 Wet Steam Inlet | Line 17 Dry Steam Outlet | Line 33 Water to Sewer |
|---|---|---|---|---|---|---|---|
| Pres., psig | 25 | 15 | 2,900 | 2,900 | 2,500 | 2,500 | 0 |
| Temp., °F. | 70 | 101 | 101 | 200 | 670 | 670 | 100 |
| Heat, MM Btu/hr | 1.7 | 3.49 | 3.49 | 8.42 | 50.90 | 43.90 | 0.29 |
| Flow, lb/hr | 44,783 | 50,000 | 50,000 | 50,000 | 50,000 | 40,500 | 4,283 |
| Steam Qual., % | | | | | 80% | 99% | |

From the above data table it will be observed that through utilization of the modular thermodynamic system and method of the present invention:

(1) The quality of the steam produced by the FBC boiler system has been increased from 80% to 99% (substantially dry steam) by removing 9,500 lbs. of water otherwise present in the boiler's steam.

(2) The boiler's feedwater has been heated from 70° F. to 200° F., recovering 6.5 MM Btu/hr of heat from the water which has been removed from the steam with no requirement for additional fuel cost.

(3) 5,217 lb/hr of boiler feedwater (BFW) has been saved reducing BFW consumption from 50,000 lb/hr to 44,783 lb/hr. Only 4,283 lb/hr. of water having a high concentration of dissolved solids has been discarded.

(4) The quality of the boiler feed water has not been altered since water in the system containing heaviest quantities of dissolved solids is segregated and discharged from the system.

While a preferred embodiment of the invention has been described and an example set forth, it is to be understood that such description and example are merely illustrative of the underlying principals of the invention and are not intended to be limiting of the scope of the invention and the following claims.

What is claimed is:

1. In the method of improving the quality of wet process steam produced by conventional and once through type boilers by removing moisture therefrom while reducing the quantity of boiler feedwater required to produce the resulting high quality dried steam, the steps comprising:

(a) introducing wet process steam from a boiler to a steamwater separation vessel to separate entrained moisture and dry the steam to form relatively dry process steam;

(b) removing from the separation vessel the separated moisture therein as a water stream including dissolved solids and passing said stream through a pressure reducing control valve to vaporize said water to form low pressure steam;

(c) introducing said low pressure steam to a low pressure flash vessel and flashing said steam therein to separate moisture therefrom and form low pressure dry steam;

(d) removing from the flash vessel the separated moisture therein as a low pressure water stream including higher quantities of dissolved solids and passing said stream through a feedwater preheater in indirect heat exchange relationship with fresh boiler feedwater to preheat said feedwater and cool said water stream;

(e) removing from the flash vessel the low pressure dry steam produced therein and passing said steam through a condensing heat exchanger to condense said steam for form a recovered hot stream of boiler feedwater substantially free of dissolved solids;

(f) mixing the preheated stream of fresh boiler feedwater with the relatively hot stream of recovered boiler feedwater in a holding tank to form a combined feedwater stream having a temperature greater than that of the preheated fresh boiler feedwater and pumping said hot combined feedwater stream under high pressure through the condensing heat exchanger in indirect heat exchange relationship with the low pressure dry steam from the flash vessel to further heat said combined feedwater stream and to condense said steam and thence to said boiler for use therein in the production of steam;

(g) discharging the water stream leaving the feedwater preheater, together with the included high quantities of dissolved solids, as a relatively cool waste stream; and (h) removing from the separation vessel, as an improved quality product, the relatively dry process steam.

2. In the method of improving the quality of wet process steam produced by conventional and once through type boilers as claimed in claim 1 wherein the wet process steam introduced to the separation vessel comprises of up to about 30% entrained moisture and the relatively dry process steam removed from said separation vessel contains less than about 1% entrained moisture.

3. In the method of improving the quality of wet process steam produced by conventional and once through type boilers as claimed in claim 1 wherein the wet process steam introduced to the separation vessel is saturated to moderately superheated steam at a temperature of from about 600° F. to about 970° F. and at a pressure of from about 500 psig to about 2,900 psig.

4. In the method of improving the quality of wet process steam produced by conventional and once through type boilers as claimed in claim 1 wherein the feedwater required to produce said process steam is heated to as much as about 200° F.

5. In the method of improving the quality of high temperature, high pressure wet process steam produced by conventional and once through type boilers by removing moisture therefrom while reducing the quantity of boiler feedwater required to produce the resulting high quality dried steam, the steps comprising:

(a) introducing wet high temperature, high pressure process steam from a boiler to a high pressure steamwater separation vessel to separate entrained moisture and dry the steam to form high temperature, high pressure relatively dry process steam;

(b) removing from the separation vessel the separated moisture therein as a high pressure, high temperature water stream including dissolved solids and passing said stream through a pressure reducing control valve to vaporize said water to form low pressure, high temperature steam;

(c) introducing said low pressure, high temperature steam to a low pressure flash vessel and flashing said steam therein to separate moisture therefrom and form low pressure dry steam;

(d) removing from the flash vessel the separated moisture therein as a low pressure, high temperature water stream including higher quantities of dissolved solids and passing said stream through a feedwater preheater in indirect heat exchange relationship with fresh boiler feedwater to preheat said feedwater and cool said water stream;

(e) removing from the flash vessel the low pressure dry steam produced therein and passing said steam through a condensing heat exchanger to condense said steam to form a recovered hot stream of boiler feedwater substantially free of dissolved solids;

(f) mixing the preheated stream of fresh boiler feedwater with the relatively hot stream of recovered boiler feedwater in a holding tank to form a combined feedwater stream having a temperature greater than that of the preheated fresh boiler feedwater and pumping said hot combined feedwater stream under high pressure through the condensing heat exchanger in indirect heat exchange relationship with the low pressure dry steam from the flash vessel to further heat said combined feedwater stream and to condense said steam and thence to said boiler for use therein in the production of steam;

(g) discharging the water stream leaving the feedwater preheater, together with the included high quantities of dissolved solids, as a relatively cool waste stream; and (h) removing from the separation vessel, as an improved quality product, the high temperature, high pressure relatively dry process steam.

6. In the method of improving the quality of high temperature, high pressure wet process steam produced by conventional and once through type boilers as claimed in claim 5 wherein the wet process steam introduced to the high pressure separation vessel is saturated to moderately superheated steam containing up to about 30% entrained moisture and is at a temperature of from about 600° F. to about 970° F. and at a pressure of from about 500 psig to about 2,900 psig and the relatively dry process steam removed from said separation vessel contains less than about 1% entrained moisture.

7. In the method of improving the quality of high temperature, high pressure wet process steam produced by conventional and once through type boilers as claimed in claim 5 wherein the feedwater required to produce said process steam is heated to as much as about 200° F.

* * * * *